US009228360B2

(12) United States Patent
Schneider

(10) Patent No.: US 9,228,360 B2
(45) Date of Patent: Jan. 5, 2016

(54) PANEL OF A FLOOR COVERING HAVING A LOCKING SURFACE SLOPED ALONG A LATERAL EDGE

(71) Applicant: Fritz Egger GmbH & Co. OG, Unterradlberg (AT)

(72) Inventor: Gerold Schneider, Hinterbruhl (AT)

(73) Assignee: Fritz Egger GmbH & Co. OG, Unterradlberg (AT)

( * ) Notice: Subject to any disclaimer, the term of this patent is extended or adjusted under 35 U.S.C. 154(b) by 0 days.

(21) Appl. No.: 14/366,148

(22) PCT Filed: Dec. 10, 2012

(86) PCT No.: PCT/EP2012/074918

§ 371 (c)(1),
(2) Date: Jun. 17, 2014

(87) PCT Pub. No.: WO2013/092270

PCT Pub. Date: Jun. 27, 2013

(65) Prior Publication Data

US 2014/0325930 A1 Nov. 6, 2014

(30) Foreign Application Priority Data

Dec. 19, 2011 (DE) ..... 10 2011 121 348

(51) Int. Cl.
*E04B 5/00* (2006.01)
*E04F 15/02* (2006.01)

(52) U.S. Cl.
CPC ... *E04F 15/02038* (2013.01); *E04F 2201/0123* (2013.01); *E04F 2201/0146* (2013.01)

(58) Field of Classification Search
None
See application file for complete search history.

(56) References Cited

U.S. PATENT DOCUMENTS

2006/0156670 A1 7/2006 Knauseder

FOREIGN PATENT DOCUMENTS

| | | | |
|---|---|---|---|
| EP | 1639215 | B1 | 6/2011 |
| WO | 2004003314 | A1 | 1/2004 |
| WO | 2004048716 | A1 | 6/2004 |

*Primary Examiner* — Patrick Maestri
(74) *Attorney, Agent, or Firm* — The Webb Law Firm

(57) ABSTRACT

A panel of a floor covering is illustrated and described, wherein a first side edge and a second side edge are arranged opposite one another and are formed corresponding to one another wherein the first side edge has first locking surfaces and the second side edge has a second locking surface, and wherein the first locking surface and the second locking surface are locked in one another. In order to be able to separate the panels of a floor covering from one another more easily and more quickly, it is envisaged that the shape of the first locking surface along the first side edge and also the shape of the second locking surface along the second side edge is inclined respectively at least over one section and corresponding to one another relative to the plane of the panel.

15 Claims, 5 Drawing Sheets

PANEL OF A FLOOR COVERING HAVING A LOCKING SURFACE SLOPED ALONG A LATERAL EDGE

CROSS-REFERENCE TO RELATED APPLICATIONS

This application is the United States national phase of International Application No. PCT/EP2012/074918 filed Dec. 10, 2012, and claims priority to German Patent Application No. 10 2011 121 348.5 filed Dec. 19, 2011, the disclosures of which are hereby incorporated in their entirety by reference.

BACKGROUND OF THE INVENTION

1. Field of the Invention

The invention relates to a panel of a floor covering, in particular a laminate floor, with a first side edge and a second side edge, wherein the first side edge and the second side edge are arranged facing opposite one another and are designed corresponding to one another so that the first side edge of the panel can be coupled to a second side edge of a similar panel by a movement approximately perpendicular to the plane of the panel, wherein the first side edge has a first locking nose with a first locking surface and the second side edge has a second locking nose with a second locking surface, and wherein the first locking surface and the second locking surface engage in the coupled state in such a way that the first side edge and the second side edge are locked against one another in a direction substantially perpendicular to the plane of the panel.

Such panels are known in various implementations and enable panels to be coupled to one another by pressing or swiveling a panel down against another panel, for example one already lying on the floor, whereby the side edges assigned to one another overlap. The panels are thus coupled to one another in a direction that is approximately or substantially perpendicular to the respective plane of the panel, wherein the important feature here is not a strict mathematical orthogonality, but is the difference in coupling the panels in the other two spatial direction, namely parallel to the plane of the panel and perpendicular to the side edge on the one hand and also parallel to the side edge and to the plane of the panel on the other hand.

The locking of the two side edges in a withdrawal, i.e. pull-out, direction perpendicular to the plane of the panel is effected via at least two locking noses, which engage one another parallel to the plane of the panel when the side edges are coupled. In this connection the locking noses engage with associated locking surfaces, which then abut one another when the two panels are loaded in the withdrawal direction. This withdrawal direction is opposite to the coupling direction and/or is directed upwardly substantially perpendicular to the plane of the panel. In addition the coupled side edges are locked to one another by suitable locking means in a direction parallel to the plane of the panel and perpendicular to the side edges.

The known panels enable floor coverings, in particular laminate floors consisting of laminate panels, to be laid quickly and simply. However, it is relatively complicated to separate the floor panels into individual panels. In order to avoid damaging the panels and allow the panels to be re-laid, the panels must be moved apart from one another along the respective first and second side edges coupled to one another, whereby the panels continue to be arranged substantially in a common plane. This operation is laborious and time-consuming. In addition coupling contours provided on the side edges can thereby be easily damaged.

2. Description of Related Art

In the case of panels with corresponding side edges that are not coupled to one another by a movement in a direction approximately perpendicular to the plane of the panel, it is known for example from WO2004/048716 A1 and EP 1 639 215 B1 to conically form certain locking surfaces in a plane of the panels. The locking surfaces then extend inclined to a plane perpendicular to the panel and parallel to the respective side edge. However, as a result of the inclined locking surfaces the side edges overall project outwardly further relative to the panel in the direction of the distal end, which is why the offcut in the panel production is larger and the panel production is more expensive.

SUMMARY OF THE INVENTION

Accordingly the object of the present invention is to modify and develop the panels mentioned in the introduction and described in more detail hereinbefore, so that the floor coverings laid with them can be dismantled more easily and quickly without thereby appreciably increasing the cost of the panels.

This object is achieved with a panel according to the pre-characterising part of claim 1, in that the shape of the first locking surface along the first side edge and also the shape of the second locking surface along the second side edge is inclined respectively at least over some sections and corresponding to one another relative to the plane of the panel.

Due to the shape of the first and second locking surface inclined at least over some sections and corresponding to one another relative to the respective plane of the panel, in the coupled state of the first and second side edges a conical or wedge shape of the corresponding locking surfaces relative to one another is achieved at least over one section. If the side edges coupled to one another are displaced slightly relative to one another, wherein this displacement direction can on account of the conical or wedge-shaped regions of the corresponding locking surfaces preferably take place only in a direction along the coupled side edges, then the inclined sections of the locking surfaces are separated from one another. The inclined sections of the locking surfaces consequently no longer abut one another on further mutual displacement of the panels, so that there is no friction any more between the corresponding sections of the locking surfaces. This has the result that two panels coupled by means of first and second side edges can be separated substantially more easily by mutual withdrawal, especially of the substantially mutually flush panels, along the coupled side edges.

The afore-discussed inclination of the first and second locking surfaces is not any arbitrary inclination. Locking surfaces inclined relative to the plane of the panel are already known. These however have a constant or at least a substantially uniform inclination along the respective side edge. When such side edges are detached from one another there is therefore not automatically an increase in the interspacing of the mutually corresponding locking surfaces of the side edges coupled to one another, and therefore there is no significant reduction in the friction of the side edges when the panels are displaced relative to one another in the longitudinal direction of the corresponding side edges. The afore-described inclination of the first and second locking surface relative to the plane of the panel is therefore understood to mean an inclination of the locking surface in a direction that has a component perpendicular to the plane of the panel.

The corresponding locking surface therefore changes, along the inclined section, its position in a direction perpendicular to the plane of the panel. In other words, the inclination of the first and second locking surfaces along the side edges in the respective section leads stepwise to an increase or a decrease of the spacing between the locking surfaces relative to a fixed plane of the panel. The locking surfaces thus change their position overall along the respective side edge in relation to the plane of the panel. One could also say that the first and second locking surfaces along the respective side edges migrate upwards or downwards over some sections, wherein upwards and downwards can be understood as directions perpendicular to the floor, to the floor covering and/or to the plane of the panel.

In order to obtain a corresponding shape of the locking surfaces along the coupled side edges despite the inclination of the locking surfaces along the side edges, the locking surfaces preferably have corresponding inclinations. The inclination of a locking surface is therefore preferably in the same direction and in addition is substantially the same amount as the opposite section of a corresponding locking surface in the coupled state. It is thus ensured that the locking surfaces of the first and second locking noses despite their at least section-wise inclination over the whole length of the side edges contribute to their locking in a direction substantially perpendicular to the plane of the panel, and the coupling of the side edges is not thereby weakened.

A plane of the panel is understood here to mean a plane that is substantially parallel to the panel, in particular to the upper side of the panel, and that in the laid state forms part of the upper side of the floor covering.

Although in principle an inclination of the first and second locking surfaces over at least some sections may be sufficient, the positive effect of these inclinations can be enhanced if the first locking surface and the second locking surface are provided at least substantially over the whole length of the first side edge and second side edge with an inclination relative to the plane of the panel. The first side edge and the second side edge then need to be displaced only slightly relative to one another in order reliably to separate both locking surfaces from one another. In addition the side edges can then be machined better at high speed and with a high degree of accuracy.

The panel may preferably be a so-called laminate panel, which generally comprises a support panel of a wood material, for example in the form of a medium density fibre board (MDF), high density fibre board (HDF), chipboard or also an oriented strand board (OSB), on the upper side of which a decoration is provided. The support panel can also be formed from a plastic or a wood-plastic composite (WPC) of a wood material and a plastic, in which a particulate or fibrous wood material can be embedded in a plastic matrix. The decoration can in principle be printed onto a paper that is embedded in a resin layer, preferably a melamine resin layer. The decoration can however also be applied in the form of a direct print. The upper side then also comprises a resin in order to protect the decoration against abrasion. In principle several layers of resin can be applied to protect the decoration, in which a fibrous material may be embedded (overlay). Very hard fine solid particles may also be embedded in the resin in order to improve the abrasion resistance and scratch resistance of the surface. In order to prevent bending of the laminate panels either a so-called counter pile in the form of a resin or lacquer layer or a so-called backing layer, in which a backing paper is embedded in a resin layer, is applied to the underneath of the panels. The joining of the support layer to the layers provided above and below the latter is normally carried out by compression at elevated temperatures. All these layers and measures are known per se and therefore do not require any further explanation.

In a first preferred configuration of the panel the two outer ends of the first locking surface are arranged offset to one another in a direction perpendicular to the plane of the panel. In other words the two outer ends of the first locking surface are arranged with respect to the longitudinal extension of the side edge at different levels referred to the plane of the panel. This difference in levels results from the inclination over at least some sections of the first locking surface along the first side edge. Alternatively or in addition the second locking surface can also be arranged perpendicular to the plane of the panel in a similar manner at different levels at the two ends of the second side edge.

The invention has also recognised that even very slight inclinations are sufficient in order to achieve the desired effect. This is advantageous in particular therefore from the production technology aspect, since the corresponding panels are typically only a few millimeters thick, in particular less than 9 mm, sometimes less than 7 mm and in some cases even less than 5 mm thick. The inclinations of the locking surfaces described hereinbefore can despite a very filigree execution of the side edges also be provided in panels that are intended to be coupled to one another by a substantially vertical movement relative to the panels. Preferably therefore the first locking surface at the two ends of the first side edge and/or the second locking surface at the two ends of the second side edge are arranged perpendicular to a plane of the panel offset relative to one another by less than 2 mm, preferably less than 1 mm, in particular less than 0.5 mm. The smaller this value the more the panels can be designed having a filigree effect and the smaller this value the thinner the panels, provided with correspondingly inclined locking surfaces, can be.

The separation of the first and second side edges coupled to one another can be simplified, like the production of the latter, if the first locking surface at least over sections over the first side edge or the second locking surface at least over sections along the second side edge is inclined by a substantially constant angle relative to the plane of the panel. It is particularly preferred in this connection if the first and second side edges are inclined at least over some sections by a substantially constant, common angle relative to the respective plane of the panel.

The inclination of the first locking surface along the first side edge may at least over some sections be less than 1.2°, preferably less than 0.6°, in particular less than 0.3° relative to the plane of the panel. The separation of even very thin panels can thus be simplified. The same applies if the shape of the second locking surface along the second side edge at least over some sections is inclined by less than 1.2°, preferably less than 0.6°, in particular less than 0.3° relative to the plane of the panel. In principle the panels should be able to be produced more cost effectively if the inclination of the locking surfaces is less. Furthermore less material then has to be removed, as a result of which the side edges are overall more stable. On the other hand the inclination of the locking surfaces should also not be too small, so that the separation of the panels can still be significantly simplified. Furthermore the inclination should be chosen smaller in the case of longer side edges, so that these can be formed in an appropriately filigree manner. With the specified inclination angles good results have been achieved as regards the above interactions.

In order to obtain as far as possible corresponding first and second locking surfaces that allow a reliable locking of the first and second side edges, it is preferred in this connection if the first and second locking surfaces are correspondingly inclined relative to one another at least over some sections by less than 1.2°, preferably less than 0.6°, in particular less than 0.3° relative to the plane of the panel. In other words, along the first side edge the first locking surface is inclined at least over some sections substantially by the same amount relative to the plane of the panel, as is the second locking surface along the second side edge at least over some sections relative to the plane of the panel.

For a reliable and permanent coupling of the first and second side edges the first locking nose can be provided on a locking element of the first side edge. Alternatively or in addition the second locking nose can for the same reason be provided on a locking element of the further side edge. The at least one locking element can for example serve to lock the first and second side edges in a direction parallel to the respective plane of the panel, this direction preferably being perpendicular to the respective side edge. Accordingly it may additionally be envisaged that in the coupled state of the first and second side edges the locking nose of the at least one locking element is provided in a locking groove.

Alternatively or in addition the first side edge and/or the second side edge can comprise a fitting tongue, wherein the respective other side edge then has a fitting groove and the fitting tongue of the at least one side edge engages in the coupled state of the first side edge with the second side edge in the at least one fitting groove of the other side edge. This enables for example the first side edge to be locked with the second side edge in a direction parallel to the plane of the panel and perpendicular to the first and/or second side edge.

To this end the at least one fitting tongue in the coupled state of the first side edge and second side edge can engage in such a way in the at least one fitting groove so as to lock the first side edge and the second side edge in a direction, and specifically for example in a direction parallel to the plane of the panel and perpendicular to the side edges coupled to one another. For a simple and compact configuration of the first and/or second side edge it may be preferred if a flank of the fitting groove and/or of the fitting tongue is formed by a flank of the locking element.

Alternatively or in addition the fitting tongue and the fitting groove can in the coupled state of the first and second side edges have contact surfaces abutting one another, which at least over one section are inclined to the perpendicular with respect to the plane of the panel. If on pulling the first and second side edges apart in a direction along the side edges the at least section-wise inclined first and second locking surfaces of the first and second locking noses the first and second locking surfaces are moved away from one another in a direction perpendicular to the plane of the panel, then a clearance perpendicular to the plane of the panel is formed between the two first and second side edges not yet completely separated from one another.

On account of this clearance the at least one fitting tongue can now be withdrawn slightly from the at least one corresponding fitting groove in a direction perpendicular to the plane of the panel. The spacing between the contact surfaces of the fitting tongue and fitting groove inclined relative to the perpendicular to the plane of the panel also thereby increases, so that also the friction between these is cancelled or at least greatly reduced if the first side edge is withdrawn further with respect to the second side edge, and vice versa.

In this connection it is preferred for production technology reasons and for a simpler coupling of the first and second side edges if the fitting tongue tapers at least over some sections towards its distal end, in particular in the region of the contact surfaces. The fitting tongue can also taper at least over some sections towards the base of the groove, in particular in the region of the contact surfaces. In order to obtain contact surfaces that correspond to a high degree, the fitting tongue and fitting groove taper uniformly with respect to one another at least over some sections, in particular in the region of the contact surfaces. In this connection the fitting groove and/or the fitting tongue can be provided uniformly along the respective side edge, which is preferred for production technology reasons.

Alternatively or in addition it may also be envisaged that in the coupled state of the first side edge and second side edge, the distal end of the at least one fitting tongue abuts the base of the groove of at least one corresponding fitting groove. This serves for the mutual support of the panels perpendicular to the plane of the panels and leads to more stable couplings between the first and second side edges.

In order to simplify the coupling of the first and second side edges and avoid damage to the side edges, at least the first sealing nose and/or the second sealing nose can be provided at a sealing lip, wherein the sealing lip adjoins at least over one section an elasticity groove. The sealing lip can thus be partially pressed into the elasticity groove when joining the side edges, so that their width is correspondingly reduced. In this way at least one sealing nose of the corresponding sealing noses can make way when coupling the first side edge to the second side edge. In the coupled state, on account of the elasticity of the locking lip, this lip and therefore also the associated locking nose is moved back at least partially to the initial position.

It is beneficial for the coupling of the first and second side edges if the at least one elasticity groove extends largely perpendicular to the plane of the panel. It is furthermore simple for production technology reasons if the elasticity groove is open at the rear side of the panel facing towards the floor.

To adjust the elasticity of the locking lip it may be advantageous if the elasticity groove is filled at least over some sections with at least one elastic filler.

The invention is described in more detail hereinafter with the aid of drawings simply illustrating exemplary embodiments. In the drawings:

DETAILED DESCRIPTION OF THE INVENTION

Figure 1:
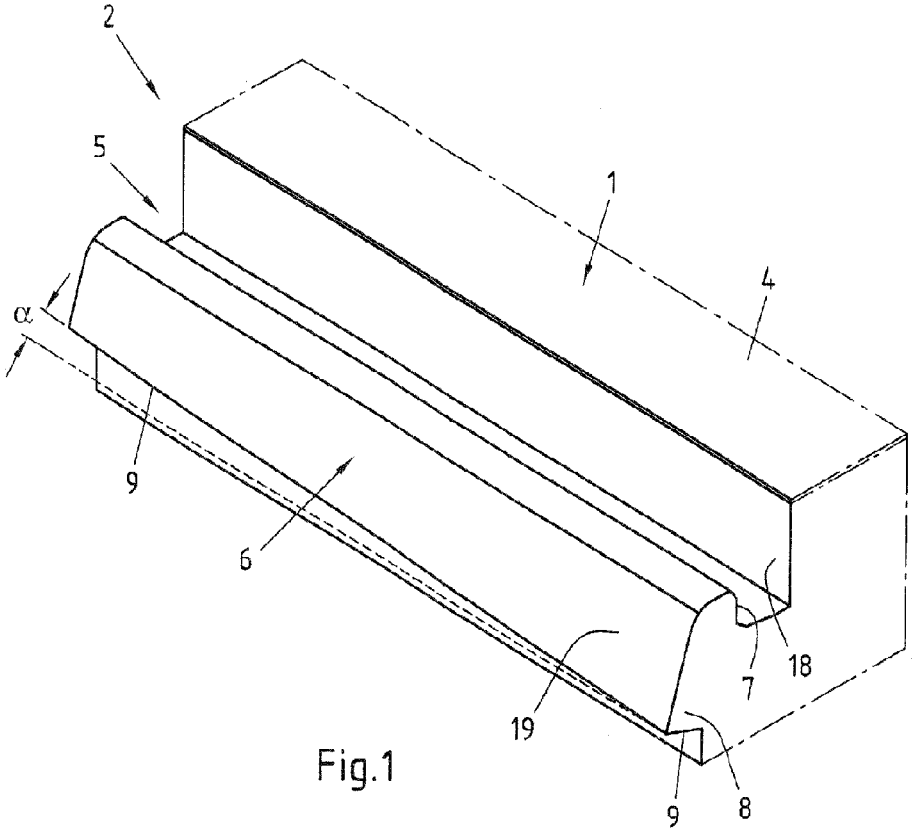
FIG. 1 is a perspective view of a first side edge of a first exemplary embodiment of the panel according to the invention.

FIG. 1 shows part of a panel 1 in a perspective view. The illustrated and to this extent preferred panel 1 is rectangular and accordingly has long and short narrow sides.

The long and short narrow sides are respectively arranged opposite one another and are respectively aligned substantially parallel to one another. The side edge illustrated in FIG. 1 is the first side edge 2 of the panel 1, which is provided on a short narrow side. The remaining side edges are for the sake of simplicity not illustrated here. A second side edge 3 is however provided opposite the first side edge 2, which is formed corresponding to the first side edge 2 so that the first side edge 2 and the second side edge 3 of similar panels 1 can be coupled to one another, as is illustrated in FIG. 2.

Figure 2:
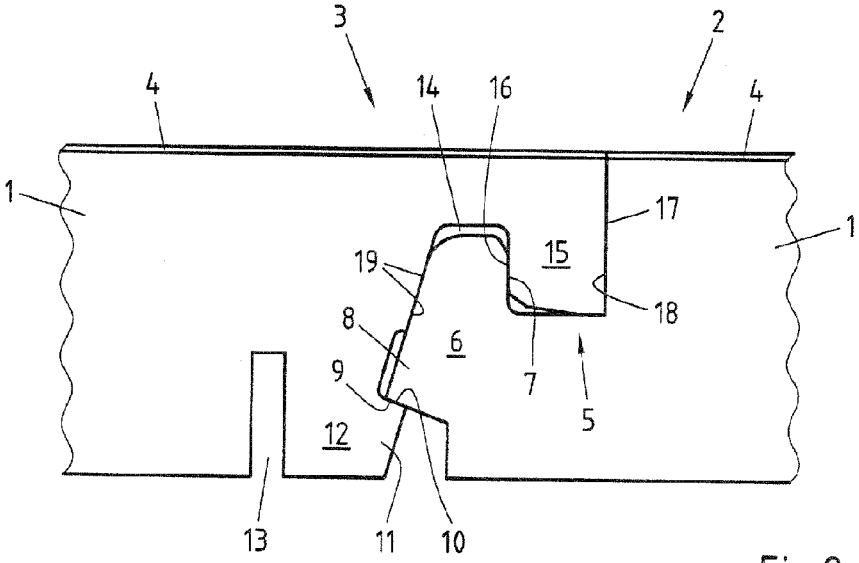
FIG. 2 is a side view of a first side edge and a second side edge of panels according to FIG. 1 in the coupled state.

In the illustrated and to this extent preferred panel 1 in FIGS. 1 and 2 a fitting groove 5 is provided on the first side edge 2 bordering the upper decorative and protective layer 4 at the distal end, said fitting groove extending substantially perpendicular downwards in relation to the plane of the panel. A locking element 6 is arranged adjacent to this fitting groove 5, which forms a common flank 7 with the fitting groove 5. This common flank 7 is the outer flank of the fitting groove 5 and the inner flank of the locking element 6. A first locking nose 8 is provided on the locking element 6 of the first side edge 2, which forms a first locking surface 9. The locking surface 9 points predominantly downwards and is aligned predominantly parallel to the plane of the panel, but is nevertheless inclined somewhat relative to the plane of the panel. This inclination is provided in the same way along the whole first side edge 2.

In the illustrated and to this extent preferred panel 1, in the coupled state the first locking surface 9 abuts a second locking surface 10 of the second side edge 3 of an adjoining, identical panel 1. The second locking surface 10 points predominantly upwards and is aligned predominantly parallel to the plane of the panel. Nevertheless the second locking surface 10 is, similarly to the first locking surface 9, inclined slightly relative to the plane of the panel.

The second locking surface 10 is provided on a second locking nose 11, which in the illustrated and to this extent preferred panel is in turn provided on a locking lip 12. The locking lip 12 extends substantially perpendicular to the plane of the panel from the top downwards and adjoins an elasticity groove 13, which likewise extends substantially perpendicular to the plane of the panel and is open to the underneath. In the coupled state the locking lip 12 engages underneath the locking element 6 with its second locking nose 11, which extends underneath the first locking nose 8 of the first side edge 2. Accordingly the first and second locking surfaces 9, 10 engage in a direction parallel to the plane of the panel. The first and second locking surfaces 9, 10 abutting one another lock the first and second side edges 2, 3 and the associated panels 1 in an upwards direction, i.e. substantially perpendicular to the plane of the panel upwardly. In other words the locking prevents the second side edge 3 lifting away from the first side edge 2.

On coupling the first and second side edges 2, 3 the elasticity groove 13 provided in the illustrated and to this extent preferred panel 1 enables the second locking nose 11 to escape rearwards with respect to the first locking nose 8, in order subsequently to move back again towards the front in the direction of the adjoining panel 1 for the purposes of locking the side edges 2, 3 according to FIG. 2.

In the illustrated and to this extent preferred second side edge 3 a locking groove 14 is provided adjacent to the locking lip 12 and adjacent to the second locking nose 11, which locking groove extends upwards substantially perpendicular to the plane of the panel and receives the locking element 6 also extending substantially upwards. The locking of the locking element 6 in the locking groove 14 is effected via the first and second locking noses 8, 11. A fitting tongue 15 adjoins the locking groove 14 at the distal end, which together with the locking groove 14 forms a common flank 16. This is the outer flank of the locking groove 14 and the inner flank with reference to the fitting tongue 15. The fitting tongue 15 is thus formed so that the fitting tongue 15 can be inserted exactly into the fitting groove 5 of the first side edge 2, and in particular preferably from above. The fitting tongue 15 then abuts with two contact surfaces 16, 17 against the contact surfaces 7, 18 of the groove flanks of the fitting groove 5.

Due to the mutual abutment of the contact surfaces, 7, 16, 17, 18 the second side edge 3 in the coupled state is locked in two directions relative to the first side edge 2. These directions are aligned respectively parallel to the plane of the panel and on the one hand point outwards perpendicular to the second side edge 3 and on the other hand point inwards perpendicular to the second side edge 3. Consequently the contact surfaces 19 provided in the illustrated panel 1 are actually superfluous above the locking noses 8, 11. The same applies to the elasticity groove 13 if the elasticity of the panel 1 is sufficient.

Figure 3:
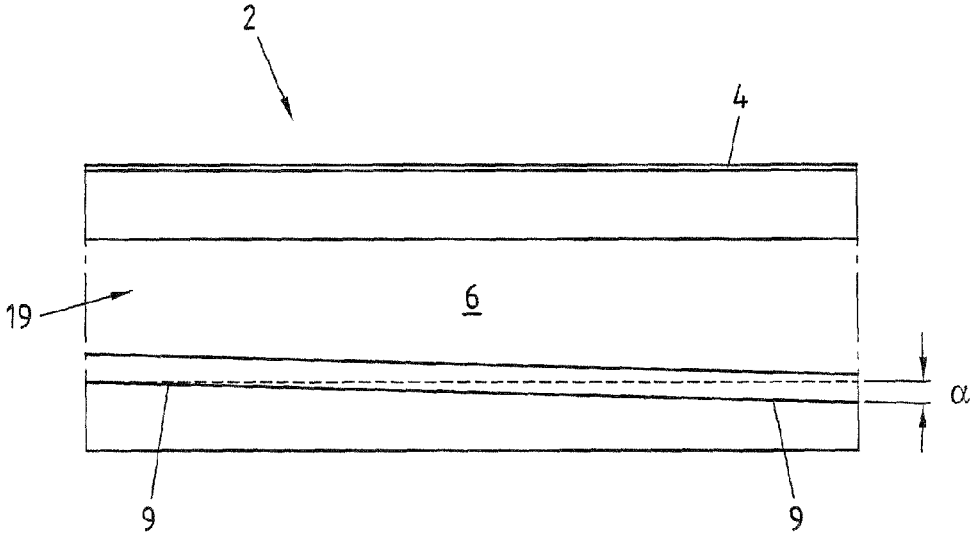
FIG. 3 is a front view of the first side edge of the panel according to FIG. 1.
Figure 4:
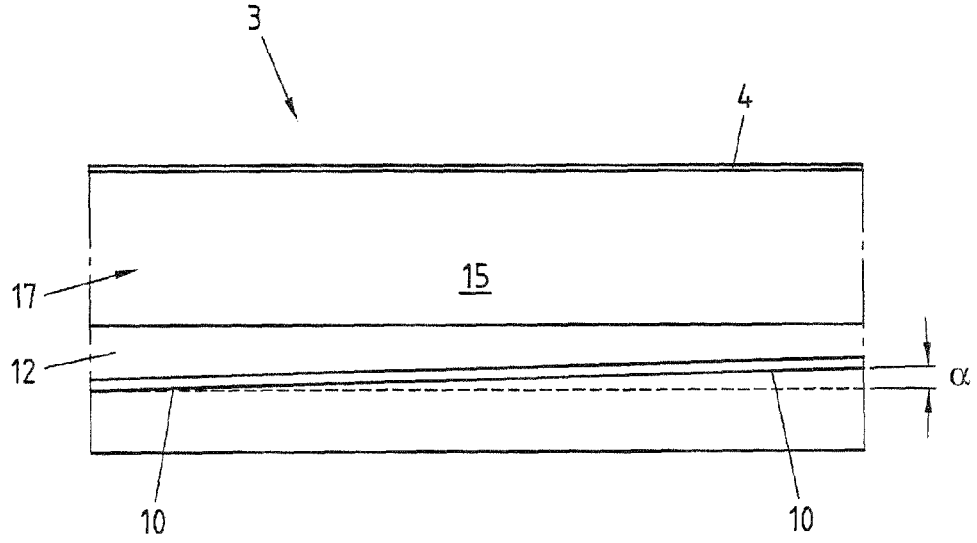
FIG. 4 is a front view of the second side edge of the panel according to FIG. 1.

In particular in FIGS. 1, 3 and 4 it is shown that the first and second locking surfaces 9, 10 do not extend to a constant height of the side edges 2, 3 from one end of the side edges 2, 3 to the respective opposite end of the side edges 2, 3. Rather, the first and second locking surfaces 9, 10 extend along the respective side edges 2, 3 with an inclination a relative to the plane of the panel. For the sake of a better comprehension this inclination a is shown exaggerated throughout in the drawing. In practice sufficient inclinations of the locking surfaces may be so small that they cannot be recognised at all or only with difficulty in the drawing.

In the illustrated and to this extent preferred panel 1 the first and second locking surfaces 9, 10 along the respective side edges 2, 3 are provided with the same constant inclination a. Accordingly the first and second locking surfaces 9, 10 abut one another over the whole length of the coupling between the first and second side edges 2, 3, in order to prevent the second side edge 3 lifting upwards away from the first side edge 2.

In the illustrated and to this extent preferred panel 1 the inclination a of the first and second locking surfaces 9, 10 is for example about 0.2°. This means that the locking surfaces 9, 10 on oppositely facing ends of the respective side edges 2, 3 are respectively mutually offset by about 0.6 mm in a direction perpendicular to the plane of the panel, and especially in the present case with side edges about 190 mm long.

Figure 5:
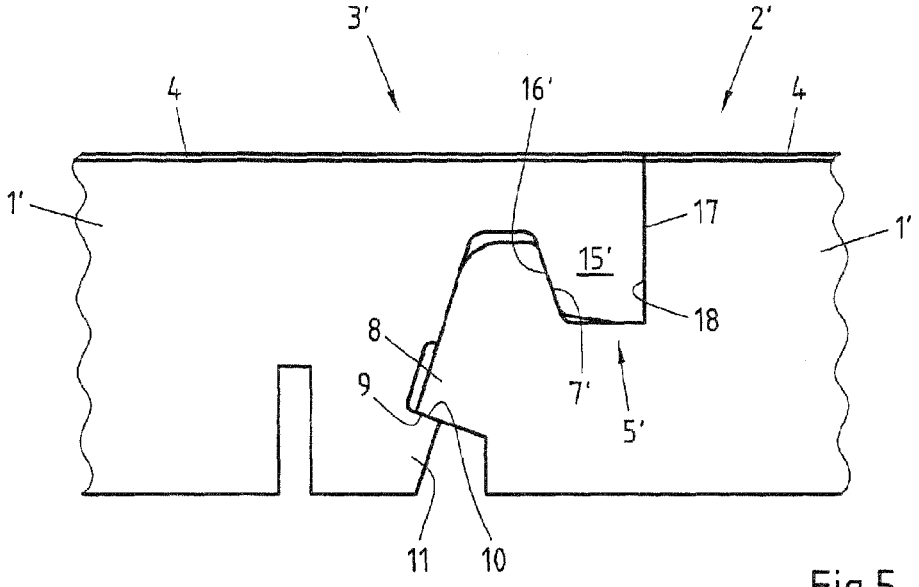
FIG. 5 is a side view of a first side edge and a second side edge of a second exemplary embodiment of the panel according to the invention in the coupled state.
Figure 6:
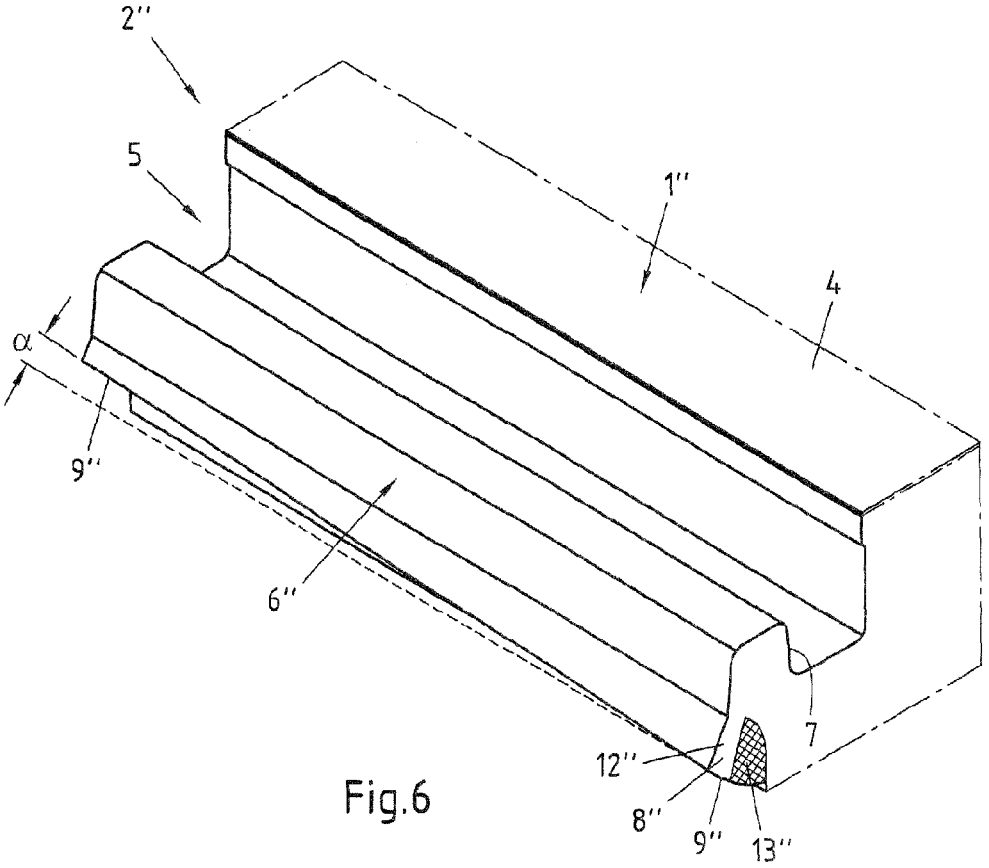
FIG. 6 is a perspective view of a first side edge of a third exemplary embodiment of the panel according to the invention.
Figure 7:
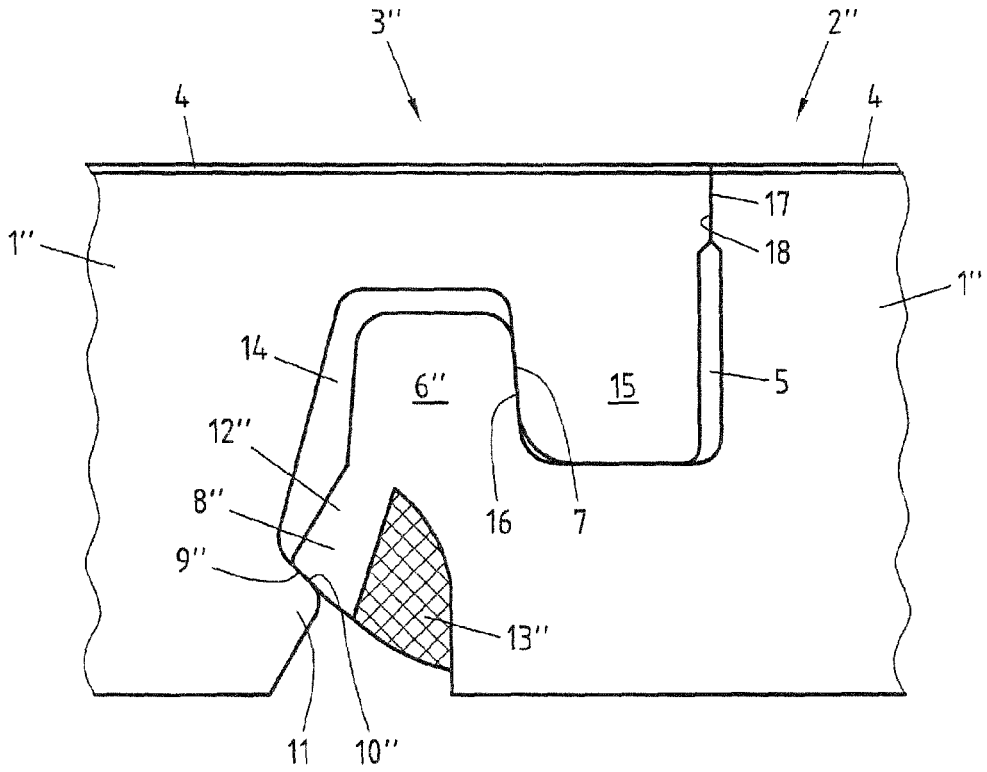
FIG. 7 is a side view of a first side edge and a second side edge of panels according to FIG. 6 in the coupled state.
Figure 8:
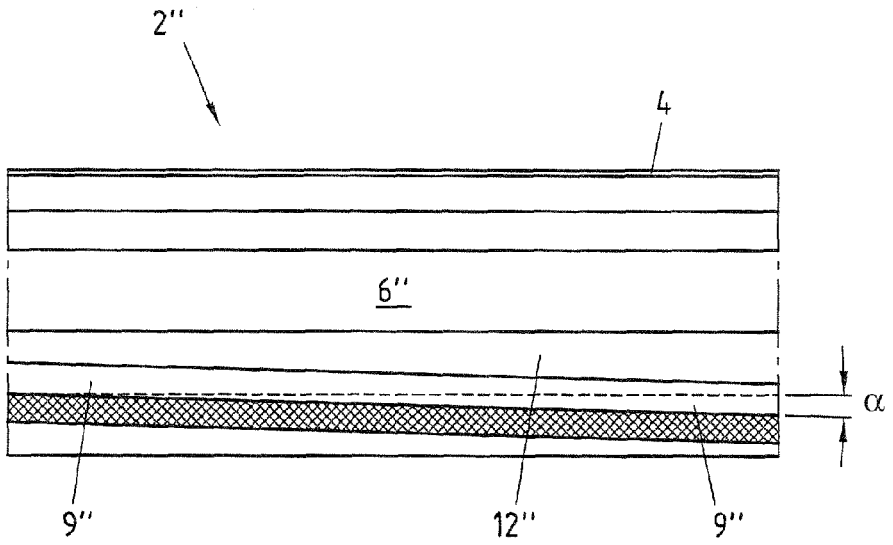
FIG. 8 is a front view of the first side edge of the panel according to FIG. 6.
Figure 9:
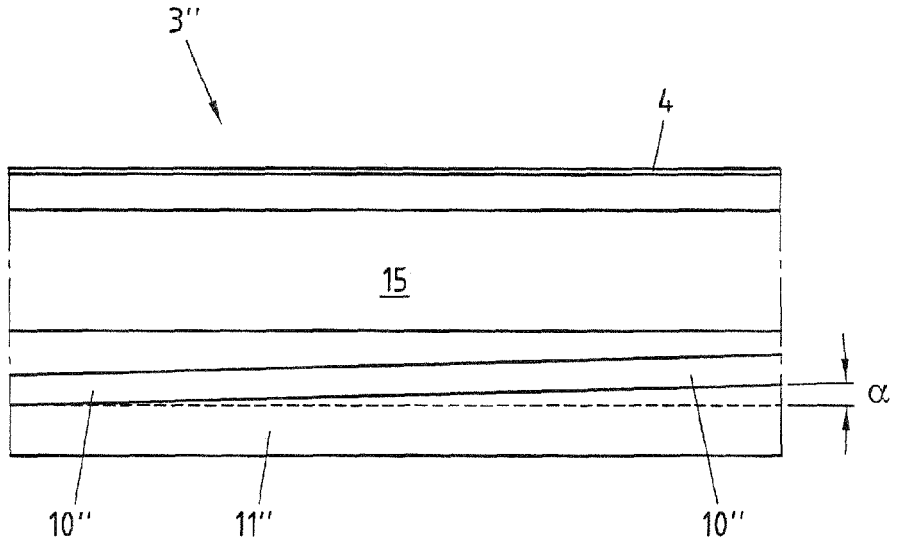
FIG. 9 is a front view of the second side edge of the panel according to FIG. 6.

The panels 1' illustrated in FIG. 5 are designed similarly to the panels 1 illustrated in FIG. 2. However, the contact surfaces 7', 16' between the inner flank of the fitting tongue 15' and the outer flank of the fitting groove 5' are not substantially perpendicular to the plane of the panel as in the case of the panels 1 according to FIG. 2, but are formed inclined significantly relative to this direction. The inclinations of the respective contact surfaces 7', 16' to the vertical relative to the plane of the panel correspond to one another and have the same magnitude. In the illustrated and to this extent preferred panel 1' the fitting tongue 15' tapers in the direction of its distal end and also the fitting groove 5' tapers in the direction of the base of its groove.

The first side edge 2, 2' and the second side edge 3, 3' are coupled to one another by slipping a second side edge 3, 3' from above downwards onto a first side edge 2, 2' of a panel 1, 1' lying on the floor. This involves a movement approximately perpendicular to the plane of the panel, in which a vertical movement can be largely avoided so long as the movement is predominantly directed from the top downwards. It may for example be envisaged that the third and fourth side edges are designed so that they can be coupled to one another by angling down. For this, a panel 1, 1' must then be swiveled from an angled position relative to the other panel 1, 1' downwards on to the floor in order to lock the third and fourth side edges together. This swiveling movement of the second panel 1, 1' about a side edge perpendicular to the first side edge 2, 2' can then form a movement that runs approximately perpendicular to the plane of the panel. In this way the first and second locking noses 8, 11 engage one another and the abutting locking surfaces 9, 10 prevent the renewed separation of the panels 1, 1' in the opposite direction to the coupling direction.

For the purposes of separation the panels 1, 1' can, for example after they have already been separated at their longer narrow edges from further rows of panels, be separated along the first and second side edges 2, 2', 3, 3' coupled to one another. The panels 1, 1' remain at the same time substantially parallel to one another and are mutually displaced, i.e. parted from one another, along the coupled side edges 2, 2', 3, 3' until the panels 1, 1' are separated from one another.

On account of the inclination a of the first and second locking surfaces 9, 10 a conical or wedge shape of the locking noses 8, 11 is produced. This means that the panels 1, 1' can only be taken apart in a direction along the first and second side edges 2, 2', 3, 3'. However, a slight displacement of the panels 1, 1' relative to one another is already sufficient in order reliably to space the first locking surface 9 and the second locking surface 10 apart from one another until the two locking surfaces 9, 10 no longer or only minimally rub against one another during further withdrawal of the side edges 1, 1'.

The increasing interspacing of the first locking surface 9 and the second locking surface 10 during the further displacement of the first and second side edges 2, 2', 3, 3' relative to one another allows a slight raising of the second side edge 3, 3' with respect to the first side edge 2, 2'. In the case of a panel according to FIG. 5 the contact surfaces 7', 16', 17, 18 between a conically shaped fitting tongue 15' and a likewise conically shaped fitting groove 5' can thus also be spaced from one another so as to reduce further the friction on further displacement of the first side edge 2' and the second side edge 3' relative to one another. If therefore the second side edge 3' has a suitable contour with respect to the first side edge 2' it can be moved somewhat upwardly and somewhat away from the first side edge 2', so that the fitting tongue 15' is no longer in contact with the fitting groove 5', without having to remove the key completely from the fitting groove 5' for this purpose. Therefore it is also unnecessary to form the fitting groove 5' and the feather key 15' in a wedge shape or conically in the direction of the side edges 2', 3'.

The panel 1" illustrated in FIGS. 6 to 9 is similar to the panel 1, 1' according to FIGS. 1 to 5, and therefore the same elements also bear the same reference numerals and the same principles apply when coupling as well as separating such panels 1, 1', 1".

The first locking nose 8" of the first side edge 2" is arranged on a locking lip 12", which on the one hand is provided on a locking element 6" and on the other hand adjoins an elasticity groove 13". The elasticity groove 13" and the locking lip 12" ensure that when coupling the first and second side edges 2", 3", the second locking nose 11" can pass the first locking nose 8" without causing any damage.

In the case of the panel 1" illustrated and to this extent preferred in FIGS. 6 to 9, the elasticity groove 13" is filled with an elastic composition, for example in the form of an adhesive. The elasticity groove 13" need however not be completely filled and also not only with an elastic composition. At least one elastic composition can be provided in a similar way in the elasticity groove 13 also in a panel 1, 1' according to FIGS. 1 to 5. The elasticity groove 13 illustrated in FIGS. 1 to 5 can however also be dispensed with.

Also in the panel illustrated and to this extent preferred in FIGS. 6 to 9, the first and second locking surfaces 9", 10" are inclined by a constant angle α along the respective side edge 2", 3", which in the illustrated and to this extent preferred panel 1" is about 1°. The regions of the first and second locking surfaces 9", 10" provided at the oppositely facing ends of the side edges 2", 3" are therefore offset by about 0.5 mm in a direction perpendicular to the plane of the panel.

The invention claimed is:

1. Panel of a floor covering with a first side edge and a second side edge, wherein the first side edge and the second side edge are arranged opposite one another and are formed corresponding to one another so that the first side edge of the panel can be coupled to a second side edge of a similar panel by a movement in a direction approximately perpendicular to a horizontal plane of the panel, wherein the first side edge has a first locking nose with a first locking surface and the second side edge has a second locking nose with a second locking surface, and wherein the first locking surface and the second locking surface in, a coupled state, engage in such a way that the first side edge and the second side edge are locked in one another in a direction substantially vertical to the horizontal plane of the panel, comprising:

the shape of the first locking surface along the first side edge and the shape of the second locking surface along the second side edge are respectively inclined relative to the horizontal plane of the panel at least over one section and corresponding to one another.

2. Panel according to claim 1, wherein the first locking surface at both ends of the first side edge or the second locking surface at both ends of the second side edge are arranged at different height levels perpendicular to the horizontal plane of the panel.

3. Panel according to claim 2, wherein the first locking surface at both ends of the first side edge or the second locking surface at both ends of the second side edge are arranged offset with respect to one another by less than 2 mm in a vertical direction perpendicular to the horizontal plane of the panel.

4. Panel according to claim 1, wherein at least over one section the first locking surface along the first side edge or at least over one section the second locking surface along the second side edge is inclined by a substantially constant angle (a) relative to the horizontal plane of the panel.

5. Panel according to claim 4, wherein the shape of the first locking surface along the first side edge is inclined at least over one section by less than 1.2° relative to the plane of the panel, or the shape of the second locking surface along the second side edge is inclined at least over one section by less than 1.2° relative to the plane of the panel.

6. Panel according to claim 1, wherein along the first side edge the first locking surface is inclined at least over one section by substantially the same amount relative to the horizontal plane of the panel, as the second locking surface along the second side edge is inclined at least over one section relative to the plane of the panel.

7. Panel according to claim 1, wherein the first locking nose or the second locking nose is provided on a locking element of the respective side edge, and wherein the locking nose of the at least one locking element is provided for locking the locking element in a locking groove.

8. Panel according to claim 1, wherein the first side edge or the second side edge has a fitting tongue, the first side edge or the second side edge has a fitting groove, and wherein, in the coupled state of the first side edge and of the second side edge, the at least one fitting tongue engages in the at least one fitting groove.

9. Panel according to claim 8, wherein the at least one fitting tongue in the coupled state of the first side edge and of the second side edge engages in the at least one fitting groove in such a way as to lock the first side edge and the second side edge in one direction and wherein this direction is parallel to the horizontal plane of the panel and perpendicular to the first side edge and to the second side edge.

10. Panel according to claim 8, wherein the fitting tongue and the fitting groove, in the coupled state of the first side edge and of the second side edge, have abutting contact surfaces, and wherein the contact surfaces are inclined along a plane perpendicular relative to the horizontal plane of the panel.

11. Panel according to claim 8, wherein the fitting tongue tapers at least over some sections towards its distal end or the fitting groove tapers at least over some sections towards the base of the groove.

12. Panel according to claim 8, wherein, in the coupled state of the first side edge and of the second side edge, the distal end of at least one fitting tongue abuts the base of the groove of at least one fitting groove.

13. Panel according to claim 1, wherein at least the first locking nose or the second locking nose is provided on a locking lip and that the locking lip adjoins at least over some sections an elasticity groove.

14. Panel according to claim 13, wherein the elasticity groove extends predominantly perpendicular to the plane of the panel and, preferably, the elasticity groove is open at the rear side of the panel facing towards the floor.

15. Panel according to claim 13, wherein the elasticity groove is filled at least over some sections with at least one elastic filler.

* * * * *

UNITED STATES PATENT AND TRADEMARK OFFICE

CERTIFICATE OF CORRECTION

PATENT NO. : 9,228,360 B2
APPLICATION NO. : 14/366148
DATED : January 5, 2016
INVENTOR(S) : Gerold Schneider It is certified that error appears in the above-identified patent and that said Letters Patent is hereby corrected as shown below:

Claims
Column 10, Line 51, Claim 4, delete "(a)" and insert -- (α) --

Signed and Sealed this
Nineteenth Day of April, 2016

Michelle K. Lee

Michelle K. Lee
*Director of the United States Patent and Trademark Office*